United States Patent [19]

Eberhardt, Jr. et al.

[11] Patent Number: 4,689,089

[45] Date of Patent: Aug. 25, 1987

[54] HEAT CONTROL FOR A DISHWASHING MACHINE

[75] Inventors: Mark E. Eberhardt, Jr., Troy; Francis J. Caldwell, West Carrollton, both of Ohio

[73] Assignee: Hobart Corporation, Troy, Ohio

[21] Appl. No.: 653,819

[22] Filed: Sep. 21, 1984

[51] Int. Cl.[4] ..... B08B 3/10

[52] U.S. Cl. ..... 134/18; 134/56 D; 134/57 D; 134/58 D; 134/105; 219/327

[58] Field of Search ..... 134/56 R, 56 D, 57 R, 134/57 D, 58 R, 58 D, 70, 72, 86, 95, 105, 124, 133, 18; 219/323, 328, 282, 296, 297, 309, 310, 312, 316, 320, 321, 327, 330, 331, 441, 480; 68/15; 422/307, 308; 137/341; 237/8 R, 8 A; 126/350 C, 362

[56] References Cited

U.S. PATENT DOCUMENTS

| | | | |
|---|---|---|---|
| 2,619,097 | 11/1952 | Bromssen | 134/57 D |
| 2,760,047 | 8/1956 | Hanson | 219/323 X |
| 2,993,108 | 7/1961 | Haake | 219/323 X |
| 3,069,735 | 12/1962 | Toulmin, Jr. | 422/307 |
| 3,123,065 | 3/1964 | Conley | 219/312 X |
| 3,186,417 | 6/1965 | Fay | 219/321 |
| 3,213,850 | 10/1965 | Heeger | 219/323 X |
| 3,575,157 | 4/1971 | Whittel, Jr. | 126/362 |
| 4,058,702 | 11/1977 | Jerles | 219/328 X |
| 4,169,978 | 10/1979 | Hauslein | 219/323 X |
| 4,313,451 | 2/1982 | Vilen | 134/72 X |
| 4,371,779 | 2/1983 | Maynard et al. | 219/328 |
| 4,420,677 | 12/1983 | Partington . | |

FOREIGN PATENT DOCUMENTS

| | | | |
|---|---|---|---|
| 2047752 | 12/1980 | United Kingdom | 68/15 |

*Primary Examiner*—Harvey C. Hornsby
*Assistant Examiner*—Frankie L. Stinson
*Attorney, Agent, or Firm*—Biebel, French & Nauman

[57] ABSTRACT

A dishwashing machine and a method for washing ware therewith are disclosed. The machine includes a wash chamber, a tank for holding a cleansing liquid, a spray system including a selectively operable pump for spraying ware to be cleaned with liquid from the tank, and a heater for heating the liquid within the tank. The heater is regulated to maintain the liquid substantially at a first predetermined temperature whenever the pump is operating, and to maintain the liquid substantially at a second predetermined temperature greater than the first temperature whenever the pump is not operating.

6 Claims, 9 Drawing Figures

HEAT CONTROL FOR A DISHWASHING MACHINE

BACKGROUND OF THE INVENTION

The present invention relates generally to dishwashing machines and more particularly, to methods and apparatus for controlling the heating of a cleansing liquid held within a tank in the machine, the liquid being used for spraying upon ware to be cleaned.

Most dishwashers operate by holding ware to be cleaned within an essentially enclosed washing chamber. A cleansing liquid, most often water having a detergent added thereto, is contained within a tank until washing commences. The water is pumped from the tank into a spray system, from which it is sprayed into the chamber and onto the ware to flush soil from the ware. As the water drains, it is directed back to the tank for recirculation.

Because heated water cleanses ware more effectively and is required for proper sanitization of the ware, the water used within the dishwashing machine is typically at a relatively high temperature at the time it initially enters the machine. In order to keep the water at a sufficiently high temperature, a heater is typically mounted within tne tank, and is energized as needed to maintain water temperature.

Sanitization considerations require not only that ware items be heated through contact with heated water at certain specified minimum temperatures, but also that the items be maintained at such temperatures for certain minimum times. Consequently, not only is water temperature important, but the quantity of such water that is sprayed on the ware and the duration of such spraying are also prime considerations. However, these concerns conflict with energy consumption considerations in that heating of water represents a substantial source of energy usage within the machine. Accordingly, it is advantageous to hold water temperatures and durations of exposure of the ware as close to the minimum for adequate cleaning and sanitation as is possible.

The foregoing is particularly important in conveyor-type commercial dishwashing machines. In single-rack type commercial machines or domestic machines, washing is typically carried out by maintaining the ware in a stationary position while it is sprayed with cleansing liquid. In such a case, it is a relatively minor matter to pump water into the spray system for a slightly longer time than the minimum. On the other hand, in a conveyor-type machine, the ware is continuously moving through the machine while it is sprayed with liquid. Thus, the ware can be sprayed only as long as it is adjacent to the spray manifolds, and the quantity of water which is sprayed onto the ware must therefore be great enough to ensure sanitation. Even so, to avoid heating greater quantities of water than needed, thereby wasting energy, it is very important that any water that is sprayed onto the ware be at the proper temperature.

What is needed, therefore, is a control system and method for a tank heater which provides an effective compromise between the competing concerns of ensuring sanitation and holding energy consumption to a minimum. Such a system should be compatible with existing overall dishwasher control systems, and should be capable of incorporation into a variety of overall control system designs.

SUMMARY OF THE INVENTION

The foregoing need is met by the present invention, which provides a system and method for controlling tank heating within a dishwashing machine. The invention stems from the recognition that, cleansing liquid that has been heated within the tank to a specified temperature may not necessarily be at that temperature once the liquid has been sprayed onto the ware. It is not uncommon for a dishwashing machine to be held in an idle condition during periods in which no ware is being cleaned. During such time, no heated water is circulated through the spray system or sprayed into the chamber, and the spray system components cool along with air within the chamber. Thus, when ware next enters the chamber and spraying is initiated, the water which initially strikes the ware is at a temperature below that of the water contained within the tank. Therefore, since that portion of the water is beneath the minimum required temperature, cleansing performance of the dishwashing machine during such time is adversely affected.

As a result, there is a time delay following starting of pump operation before the tank heater is able to bring the temperature of the heated water back to the desired level. Thus, rather than wash ware with water at lower temperature, it would be possible to operate the pumps without ware being present in the machine until proper temperature has been achieved. This is disadvantageous, however, since it wastes the energy needed to drive the relatively large pump motors.

Another problem which has now been recognized in connection with the heating of cleansing liquid within a tank is that stratification of the heated liquid occurs while the liquid is standing in the tank. In other words, the liquid closest to the heater is heated to a higher temperature than liquid at, for example, the outer sides of the tank. Upon pumping start up, the liquid is mixed, thereby producing a temperature drop in the warmest portion of the liquid. If the thermostat for regulating the heater is mounted physically near the heater, this effect can also produce an initial period in which water below the desired temperature is being used to clean the ware.

In view of the recognition of these problems, the present invention provides a method and system for controlling tank heating in a dishwashing machine having a wash chamber, a means for supporting ware to be washed within the chamber, and a tank for holding a cleansing liquid. A spray means includes a pump selectively operable for spraying the liquid from the tank onto ware held within the chamber. A heater means heats the liquid within the tank, and a regulating means regulates the heater means to maintain the liquid substantially at a first predetermined temperature. In accordance with the improvement of the present invention, the regulating means alternatively regulates the heater means to maintain the liquid substantially at a second predetermined temperature greater than the first temperature. A control means controls the heater means and the regulating means such that the regulating means regulates the heater at the first temperature whenever the pump is operating, and regulates the heater at the second temperature whenever the pump is not operating.

By providing a heat offset during periods when the pumps are idle, any temperature drop occurring at pump start up will only lower the temperature to the normal operating temperature. Thus, the cleansing performance of the dishwashing machine is not affected.

Accordingly, it is an object of the present invention to provide a dishwashing machine and dishwashing method in wnich adequate sanitation of cleaned ware is ensured with only minimum usage of heated water; to provide such a machine in which the cooling of spray system components during idle dishwasher periods is properly accounted for; and to provide such a machine in which control of tank heating is provided in a manner which can be readily incorporated into various types of dishwasher control systems.

Other objects and advantages of the present invention will be readily apparent from the following description, the accompanying drawings, and the appended claims.

DETAILED DESCRIPTION OF THE PREFERRED EMBODIMENTS

Figure 1:
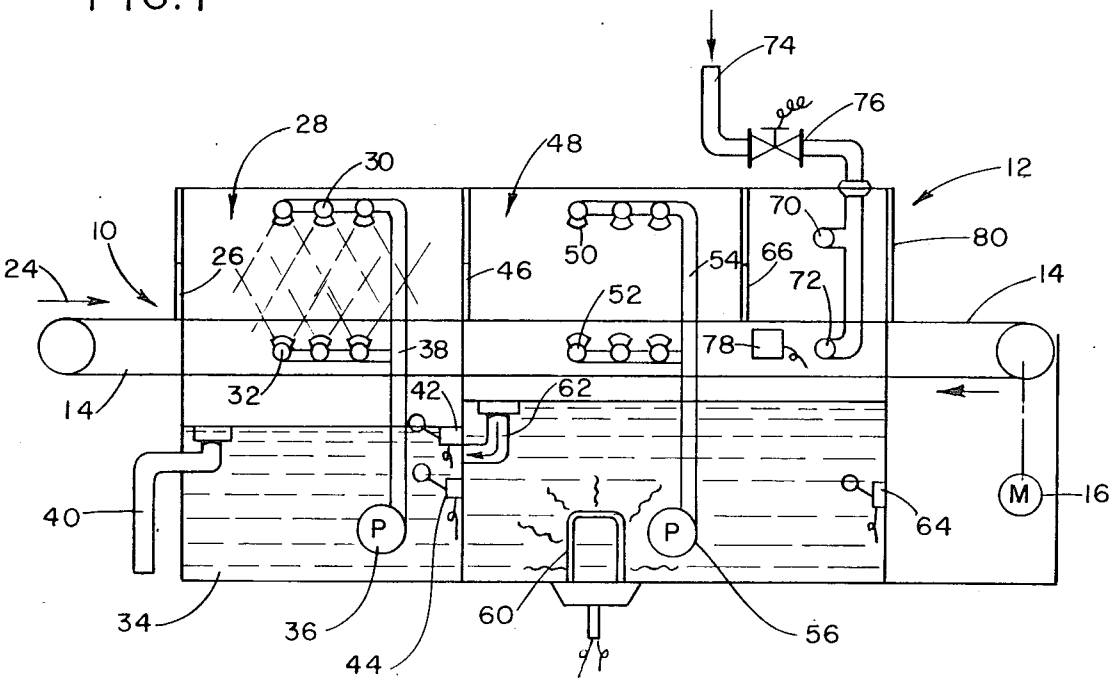
FIG. 1 is a generally schematic side view of a conveyor-type dishwasher to which the present invention can be applied.

Referring now to the drawings, FIG. 1 illustrates a model of a conveyor-type dishwashing machine to which the present invention is applicable. In such a machine, which is shown from the forward or operator side, soiled ware, either placed in racks or as individual items, is moved through tunnel-like chambers within the machine from an entrance end 10 to an exit end 12 by a conveyor 14. Conveyor 14 is driven at exit end 12 of the machine by a motor 16.

Ware placed on the conveyor 14 at the entrance end 10 of the machine is carried in the direction of arrow 24 through a flexible curtain 26 and into a prewash chamber 28. Sprays of liquid from upper and lower prewash manifolds 30 and 32 above and below the conveyor path, respectively, function to strip and flush heavier soil from the ware. The liquid for this purpose comes from a tank 34 via a pump 36 and supply conduit 38. The level in this tank is maintained by a standpipe 40 which overflows to drain. A float switch 42 is mounted to the interior of tank 34 to provide a signal to the control system, as will be described in detail below, when tank 44 has been properly filled. A second float switch 44 is provided at a lower level within tank 44 to provide a signal when the tank has been sufficiently filled to permit operation of pump 36.

Ware proceeds through a next curtain 46 into a wash chamber 48, where the ware is subjected to sprays of cleansing liquid from upper and lower wash manifolds 50 and 52, respectively, these being supplied through supply conduit 54 by a pump 56 which draws from wash tank 58. A heater, shown as an electrical immersion heater 60, is provided to maintain the temperature of the wash liquid at a suitable level. Not shown, but also included, is a device for adding a cleansing detergent to the liquid in tank 58, along with controls for this device that maintain the concentration of the detergent within desired limits. Overflow from tank 58 exits via pipe 62 into the prewash tank 34. A float switch 64 is mounted within tank 58 so as to be actuated once the level of liquid within tank 58 is sufficiently high that heater 60 and pump 56 are completely submerged.

After passing through curtain 66, the ware enters final rinse chamber 68. This chamber is provided with upper and lower spray heads 70 and 72, respectively, that are supplied with a flow of fresh hot water via pipe 74, under the control of a solenoid operated rinse valve 76. A ware sensor 78 is mounted within rinse chamber 68 so as to detect the entry of ware items into the chamber. Through suitable electrical controls, as will be described below, energization of valve 76 admits hot rinse water to the spray heads 70 and 72 whenever ware is present within the chamber. The fresh water then drains from the ware into tank 58.

The cleaned ware exits the dishwashing machine through curtain 80 at exit end 12. The ware can then be removed from conveyor 14.

Heater 60 is operated to maintain the washing liquid within tank 58 at a level suitable to ensure thorough cleansing and proper sanitization of the ware. In accordance with the present invention, heater 60 is regulated to heat tne water to a first temperature, for example, on the order of 160° F., whenever pump 56 is operating to circulate ware from tank 58 for spraying onto the ware. The heater is furtner regulated so that whenever pump 56 is not operating, water within the tank will be heated to a second, higher temperature, for example, on the order of 170° F. In this manner, cooling of supply conduit 54, manifolds 50 and 52, and the air within wash chamber 48 is accounted for so that upon initiation of pumping by pump 56, wash water striking the ware will be substantially at the first temperature. Appropriate controls for providing this heat offset, which is preferably between 5° F. and 15° F. and, more preferably 10° F., are described in detail below.

It may appear intially that provision of a heat offset is contrary to the goal of reduced energy consumption discussed above. However in the absence of such offset, the initial portion of water sprayed on the ware upon starting of pump 56 will not be as effective for cleaning and sanitizing the ware. Thus, a greater quantity of water will be required to be sprayed on the ware, with this additional water requiring full heating to the first temperature. No extra water is available in a conveyor-type machine, unless higher capacity pump motors and spray systems are used, which require greater energy input. With the heat offset of the present invention, however, water already heated to the first temperature need only be increased in temperature a relatively small amount to the the second temperature, and it is believed that such an approach may be more energy efficient. This is particularly true at many locations where dishwashing machines are installed, where pumps may be idle only for a relatively small proportion of the operating day. In such a case, a lower required quantity of water represents an important energy savings. In any event, by having all water sprayed on the ware at or at least the desired operating temperature, better cleaing results will be achieved.

Figure 2:
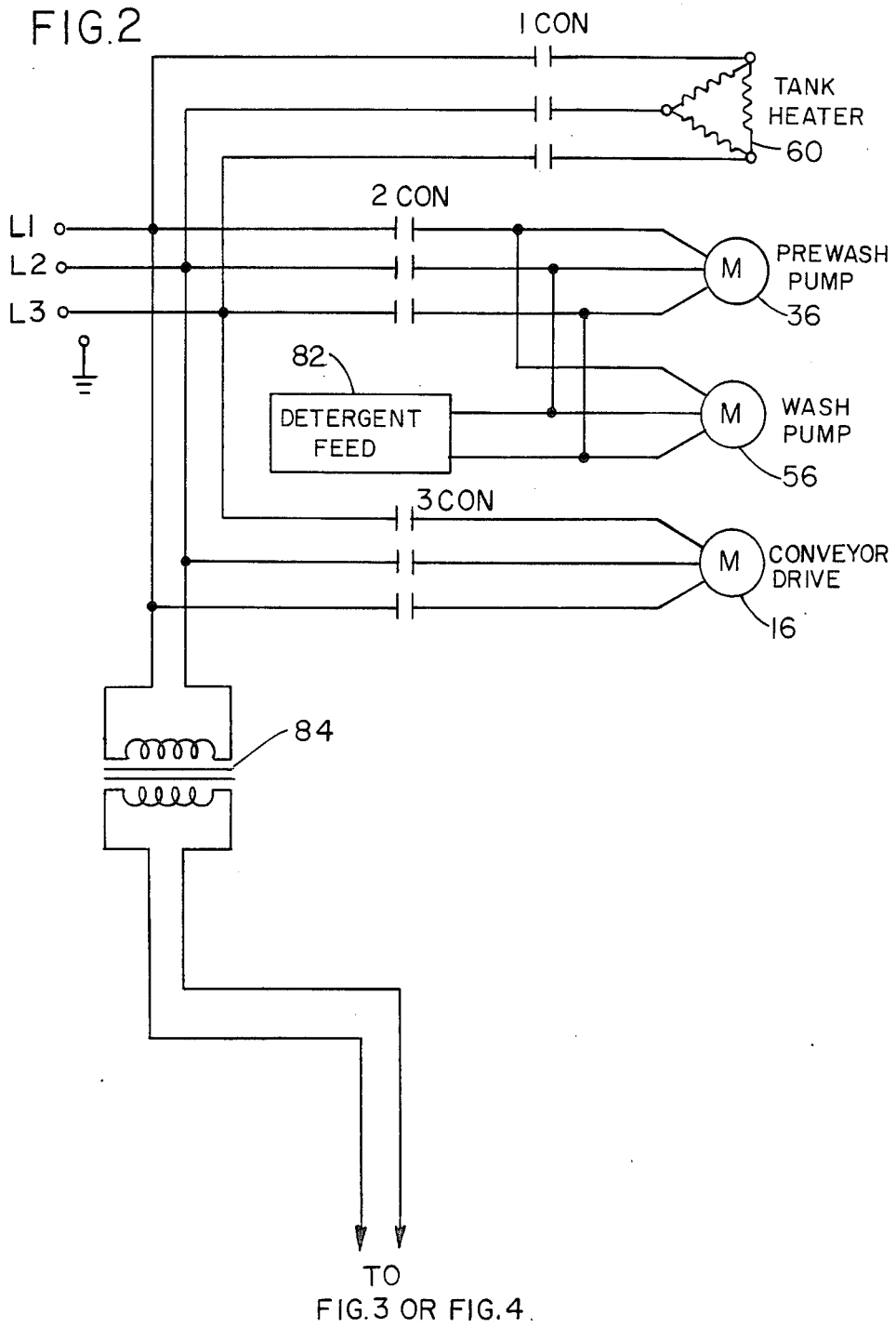
FIG. 2 is a diagram illustrating schematically the wiring for supplying power to the primary dishwasher components.

The wiring for supplying power to the primary components of the dishwashing machine is shown schematically in FIG. 2. Electric power is input at terminals L1, L2 and L3, and can be from 200 to 500 volts AC, depending upon locally available power supplies. Power supplied to tank heater 60 passes through a plurality of contacts associated with a contactor coil 1CON, with the coil itself being located in other portions of the wiring system, as will be described in detail below.

Prewash pump 36 and wash pump 56 are controlled by contacts associated with contactor coil 2CON, as is a detergent feeder 82. Thus, pump 36, pump 56 and detergent feeder 82 all operate simultaneously. Conveyor drive motor 16 is controlled through contacts associated with contactor coil 3CON. Power is also supplied to a transformer 84 which reduces the line voltage to 120 volts AC, which is in turn supplied to the control circuitry shown in either of FIGS. 3 or 4.

Figure 3:
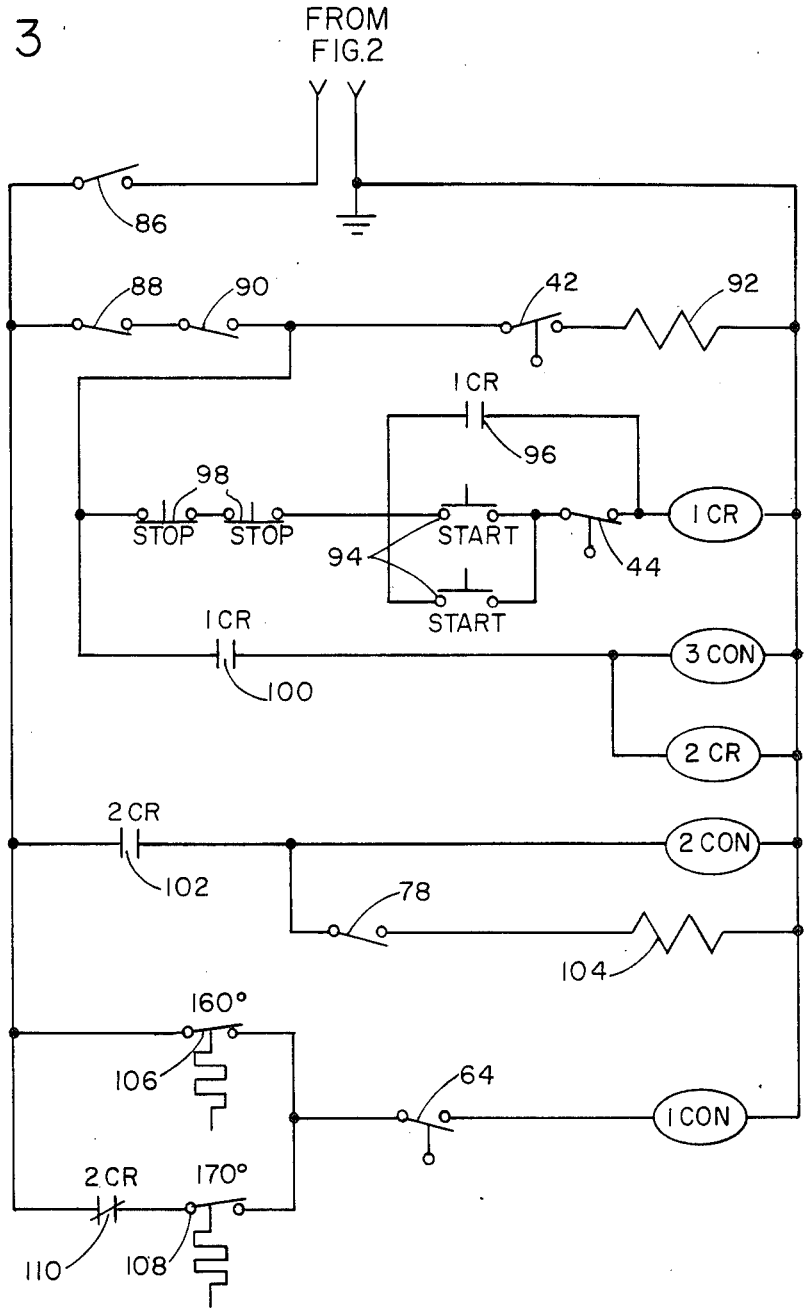
FIG. 3 is a schematic diagram of an embodiment for the tank heat control incorporated within the present invention.

Referring now to FIG. 3, an embodiment for the control circuitry for controlling the dishwashing machine of FIG. 1 is shown. A control power switch 86 is provided, and is the normal means by which the dishwashing machine is turned off and on between operational periods. Closing switch 86 connects power to the remainder of the circuitry.

Although not shown in FIG. 1, the dishwashing machine includes an access door located on the operator side of both the prewash chamber 28 and the wash chamber 48. These doors enable the machine operator to gain access to the interior of the dishwasher. Each door is associated with a contact switch that is open when the corresponding door is opened, and closed when the door is closed. These switches are shown as switches 88 and 90 in FIG. 3.

A fill solenoid 92 is associated with a fill valve that enables water to be introduced into tank 58. Upper prewash float switch 42 is connected in series with solenoid 92, so that whenever float switch 42 indicates that prewash tank 34 is less than completely full, solenoid 92 is energized to permit additional water to be introduced into tank 58. It will also oe noted that power to solenoid 92 also passes through door switches 88 and 90, so that filling can occur only when the doors associated with these switches are closed.

Conveyor start and stop push-button controls are provided at each end of the machine near entrance end 10 and exit end 12. The conveyor start switches 94 are connected in parallel, and are both normally open switches. Actuation of either switch energizes the coil of control relay 1CR, which then latches itself through contacts 96 to by-pass switches 4. Stop switches 98 are normally closed switches, and are connected in series such that actuation of either switch 98 interrupts power to and unlatches control relay 1CR.

Energization of relay 1CR closes contacts 100, which energizes contactor coil 3CON and control relay 2CR. Contactor coil 3CON in turn closes contacts for energizing conveyor drive motor 16 (see FIG. 2). Thus, it can be seen that actuation of start switches 94 results in starting of conveyor motor 16. However, the conveyor will not operate if either door has been opened, as this will open either door switch 88 or 90. Additionally, it can be seen that control relay 1CR cannot be energized without float switch 44 being in its raised position. Thus, the conveyor cannot be started unless sufficient water is present in tank 44 to cover prewash pump 36.

Contacts 102, associated with control relay 2CR, are closed upon starting of conveyor drive motor 16. Closure of these contacts energizes contactor coil 2CON, which in turn actuates pumps 36 and 56. Thus, the pumps will operate whenever conveyor 14 is in motion. At the same time, rinse solenoid 104 is enabled such that subsequent closure of sensor switch 78 will cause fresh, heated rinse water to be admitted to final rinse manifolds 70 and 72 for spraying on the ware.

Temperature control within wash tank 58 is provided through a pair of normally closed thermostats 106 and 108. These control power supply to contactor coil 1CON which, when energized, provides electrical power to tank heater 60 (FIG. 2). Float switch 64 is also connected in series with contactor coil 1CON, so that heater 60 cannot be energized unless sufficient water is present within tank 58 to cover the heater.

Thermostat 106 is selected to open at a first predetermined temperature, preferably approximately 160°. Thermostat 108 opens at a higher, second temperature, preferably approximately 170°. Thermostat 108 is connected in series with normally closed contacts 110 associated with control relay 2CR. Since this relay also controls actuation of pumps 36 and 56, contacts 110 will open whenever the pumps are energized.

In operation, at temperatures above 170°, both thermostats 106 and 108 will be open and tank heater 60 will be deenergized, regardless of the status of pump 56. Similarly, at temperatures below 160°, thermostat 106 will be closed, thereby permitring energization of heater 60 through thermostat 106, again regardless of the status of pump 56. Between 160° and 170°, however, energization of heater will depend upon whether pump 56 is operating. If so, contacts 110 will be open, and, assuming a temperature over 160°, thermostat 106 will be open, thereby deenergizing the heater. If pump 56 is not operating, contacts 110 will be closed, and assuming a temperature below 170°, power is provided to actuate heater 60 through thermostat 108.

Figure 4:
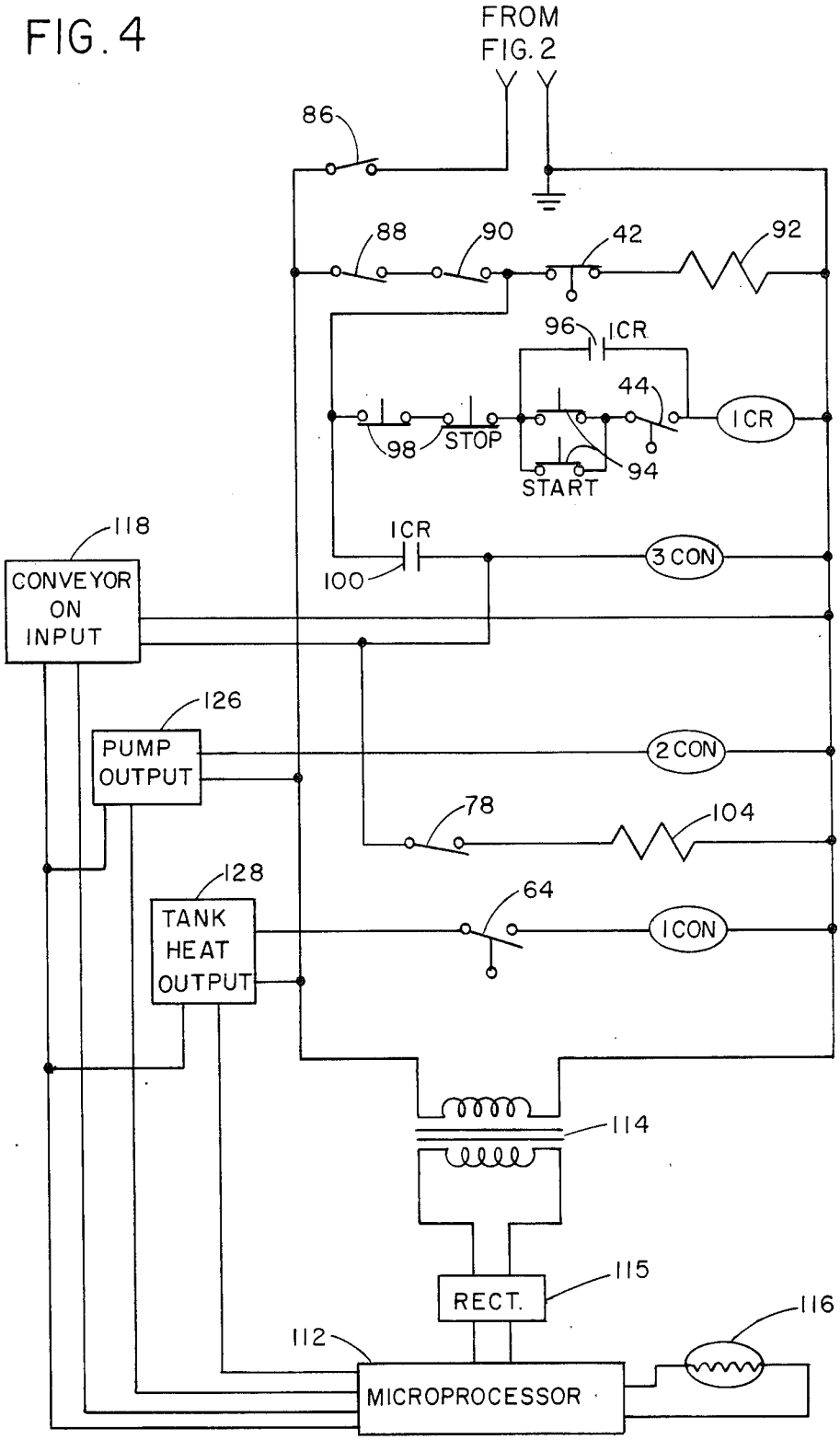
FIG. 4 is a schematic diagram of an alternative embodiment for tne control system shown in FIG. 3.

An alternative embodiment to the control system of FIG. 3 is shown in detail in FIG. 4. In general, the control system is similar to that of FIG. 3, with like reference numerals applied to like parts. However, the control system of FIG. 4 operates in part under the control of microprocessor 112, which is supplied power through a transformer 114 and rectifier 115. A thermistor 116 is mounted within tank 58, and provides data relating to the temperature of the liquid held within tank 58 to microprocessor 112. An input module, designated as "conveyor on" input module 118, is provided to indicate to microprocessor 112 whenever power is supplied to contactor 3CON, energizing conveyor drive motor 16.

Figure 5:
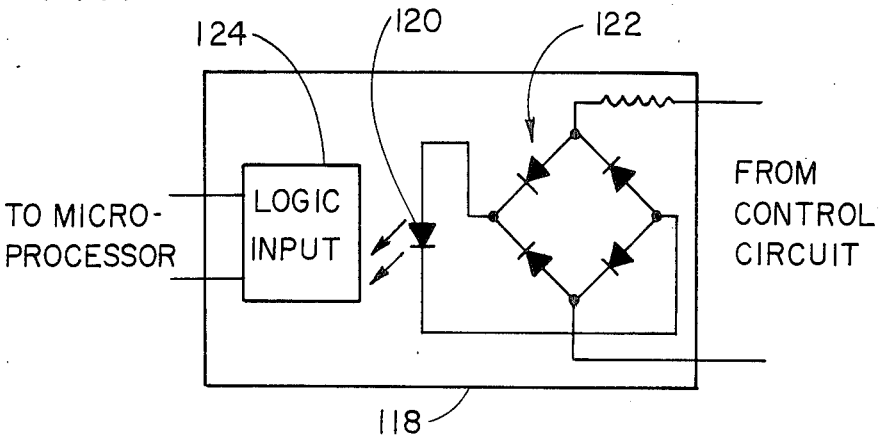
FIG. 5 is a schematic diagram of the input module used within the circuit of FIG. 4.

Input module 118 is shown in greater detail in FIG. 5, and includes a light-emitting diode 120 connected across a bridge rectifier 122. A logic input unit 124 includes a photodetector, so that when power is input into module 118 from the control circuit, LED 120 emits light which is detected in logic input unit 124. In response, a logic signal is sent to the microprocessor.

Figure 6:
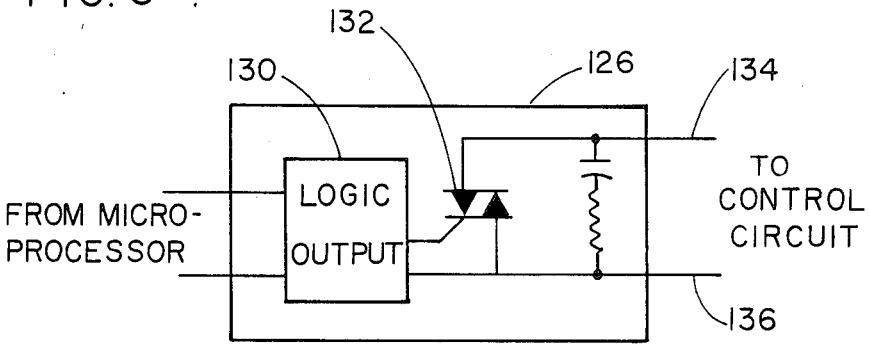
FIG. 6 is a schematic diagram of the output modules used within the circuit of FIG. 4.

Returning to FIG. 4, a pair of output modules, pumps output module 126 and tank heat output module 128 are provided. These enable microprocessor 112 to control the energization of contactor coil 2CON to operate pumps 36 and 56, and contactor coil 1CON to operate tank heater 60, respectively. Both output modules 126 and 128 are identical in construction, with module 126 shown in detail in FIG. 6. A logic signal generated by microprocessor 112 is directed to logic output unit 130, which in turn triggers triac 132 to permit current to flow through lines 134 and 136 from the control circuitry.

Figure 7A:
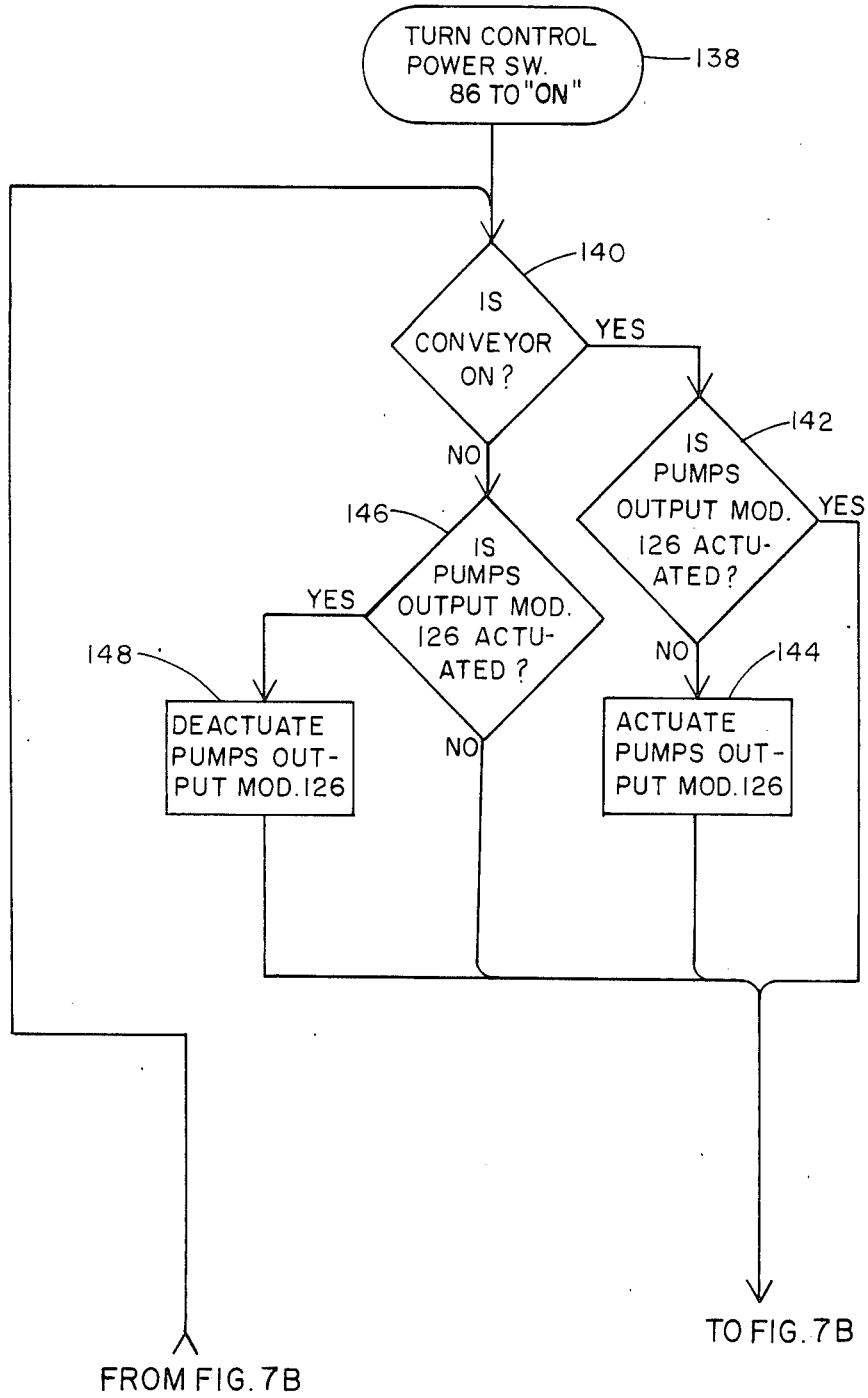
FIGS. 7A–7C together form a flow chart illustrating operation of the microprocessor of the control system of FIG. 4.
Figure 7B:
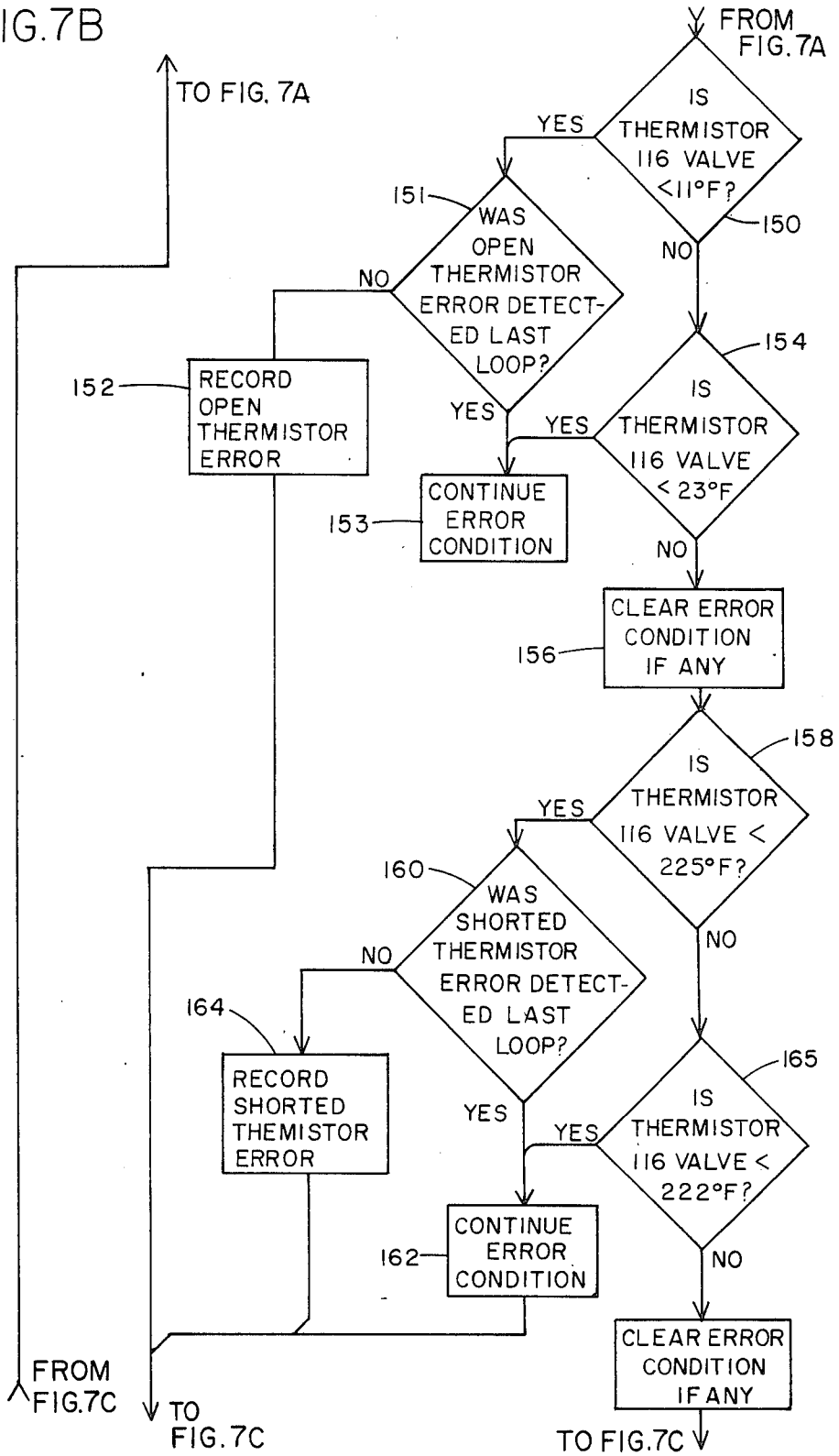
Figure 7C:
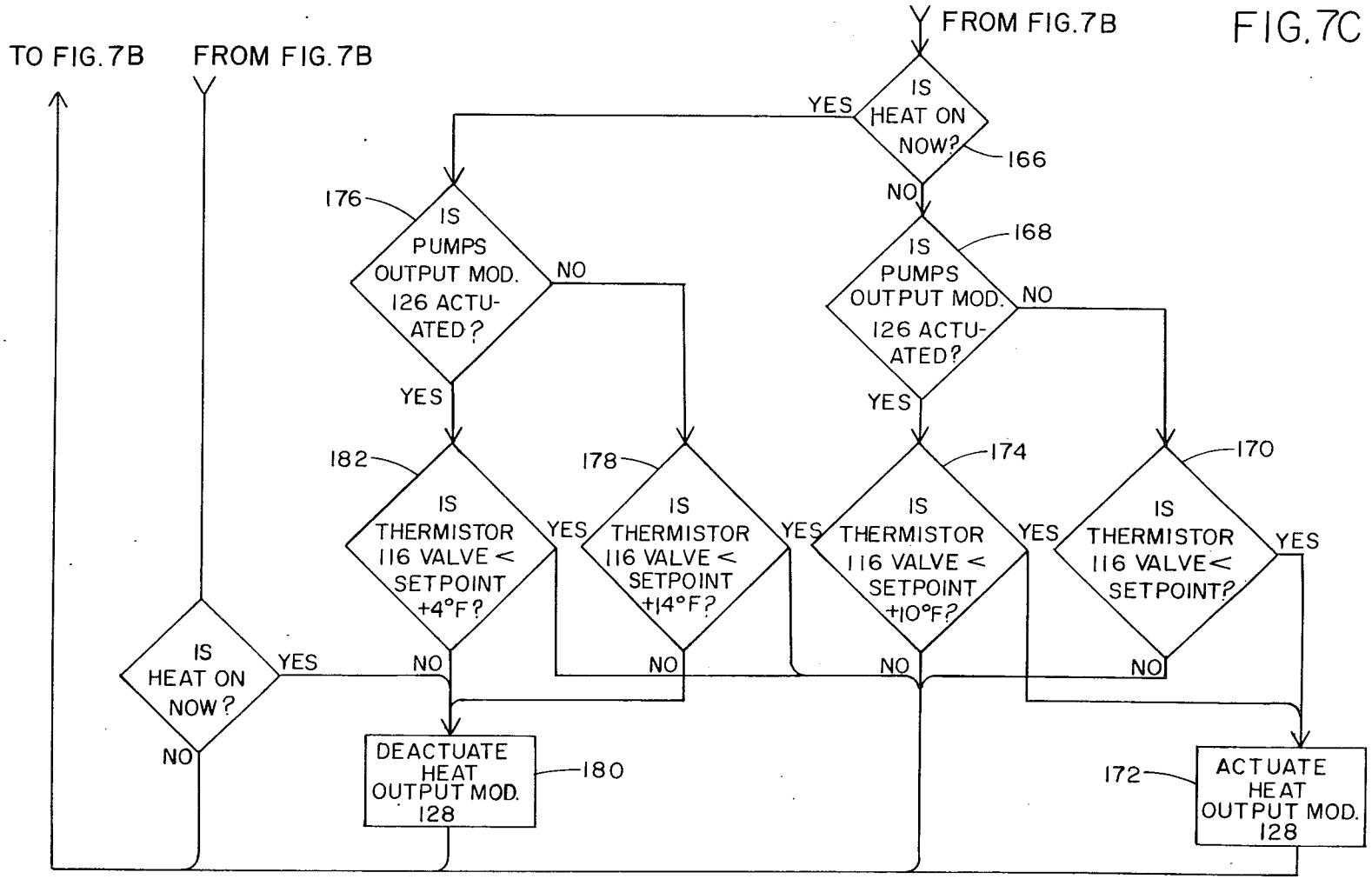

The operation of microprocessor 112 with the control circuitry of FIG. 4 can be understood by reference to the flow chart diagram shown in FIGS. 7A–7C. The program routine is reset upon power up of microprocessor 112, which occurs whenever control power switch 86 is moved to its "on" position, shown at 138 in FIG. 7A. Moving into the main program loop, the program checks the status of input module 118 at block 140 to determine whether conveyor 14 is currently operating. If so, it is determined at block 142 if pump output module 126 is presently actuated. If so, the program continues to the next step, but if the pumps are currently not operaring, pumps output module 126 is actuated as indicated in block 144.

If the conveyor is not on, the program nonetheless determines at block 146 whether pumps output module 126 is currently actuated. If so, it is deactuated at block 148.

The program next performs a check to determine that thermistor 116 is functioning properly. The present value input from thermistor 116 is checked at block 150 to determine whether it is less than 11° F. If so, it is assumed that an open thermistor condition exists, and the microprocessor memory is checked at block 151 to determine whether an open thermistor error was detected during the preceding loop through the program. If not, such an error is recorded in memory at block 152 so that a total number of errors can be kept to aid in diagnosing machine malfunctions or to provide a display indication to the machine operator that a problem currently exists. If the error has already been recorded, the error condition is simply continued, as shown at block 153. Next, at block 154, the program determines whether the value is less than 23° F. If so, the error condition is continued. This difference betwen initiating an error condition below 11° but continuing it below 23° is provided to avoid rapid cyclying between error and non-error conditions if the thermistor value approaches 11°. If the thermistor value is above 23°, any error conditon which may still be present is cleared at block 156.

Next, at block 158, the program determines whether the thermistor value exceeds 225° F. If so, it is assumed that a shorted thermistor condition exists, and the program at block 160 determines whether such a condition was detected during the last loop through the program. If so, the error condition is continued at block 162 and, if not, the error is recorded in memory at block 164. Here, an error condition is cleared at thermistor values below 222° F., as shown at block 165.

If no thermistor errors are present, the program determines whether tank heat output module 128 is currently actuated at block 166. If heat is not presently being applied, the program determines at block 168 whether the pump output module 126 is currently actuated. If so, the value of thermistor 116 is checked at block 170 to determine whether it is less than a predetermined set point temperature for wash tank 58, preferably 160° F. If not, the program continues on, but if the temperature is below the setpoint, the heat output module 128 is actuated in block 172.

Since the present invention is designed to provide a higher liquid temperature within tank 58 during times in which the pumps are not operating, a determination at block 168 that pump output module 126 is actuated directs the program to block 174, in which it is determined whether the value of thermistor 116 is less than the setpoint plus 10° F. In this instance, only if the value of thermistor 116 is greater than the higher value will heat output module 128 be actuated at block 172.

Moving back to block 166, if the program determines that tank heat is presently on, the program moves to block 176 where it is determined whether pump output module 126 is currently actuated. If so, the program determines at block 178 whether the value of thermistor 116 is less than the setpoint plus 4° F. If not, heat output module 128 is deactuated at block 180. If pump output module 126 is not actuated, and therefore a higher temperature within tank 58 is desired, the program determines at block 182 whether the value of thermistor 116 is less than the setpoint plus 14° F. If not, heat output module is deactuated at block 180 and, if so, the program continues on, permitting heater 60 to continue to operate.

It will be noted that deactuation temperatures exceed actuation temperatures by 4° both in cases where pumps are operating and pumps are not operating. This difference is provided so that in the event temperature within tank 58 is at or near the setpoint (or the setpoint plus 10°), the tank heat output module 128 will not be repetitively cycled on and off. This is important in the embodiment utilizing the microprocessor 112, due to the more precise control obtained using thermistor 116 and microprocessor 112 than is possible with thermostat switches.

Once this portion of the program has been completed, the program is looped back to block 140 so as to perform the program once again.

It should be recognized that, as used in the present description and the appended claims, the terms "first temperature" and "second temperature" are not limited to exact, specifically defined values, but can include approximate ranges as well. As has been noted, in the embodiment just described the "first temperature" encompasses temperatures extending from the setpoint to the setpoint plus 4° F. In the case of the emoodiment shown in FIG. 3, the imprecise nature of thermostats results in the "first temperature" similarly being somewhat imprecise. In any case, however, it is the difference between the first and second temperatures, even though such difference may realistically be only an approximate value, that is central to the present invention rather than the specific temperature values themselves.

A more comprehensive microprocessor-based control system can be seen by reference to commonly-assigned U.S. Pat. No. 4,561,904, filed on even date herewith, entitled "Control System for a Dishwashing Machine"), which is hereby incorporated by reference. The control system disclosed therein operates in an essentially identical manner to that disclosed herein, with respect to control of the heating of tanks within the dishwasher machine. The incorporated disclosure does, however, provide a system in which the remaining components of tne dishwashing machine are also controlled utilizing a microprocessor. In addition, operations for cleaning ware ware within the machine are sequenced such that pumps are operated only when ware is present within prewash or wash chambers, rinsing occurs only when ware is present within tne final rinse chamber, and a drying operation for the ware is performed only when ware is present within a disclosed drying chamber. The incorporated disclosure is not necessary to enable one skilled in the art to practice the present invention, but does disclose an additional mode for carrying out the invention.

While the method and forms of apparatus disclosed herein constitute preferred embodiments of this invention, it is to be understood that the invention is not limited to the precise method and forms of apparatus, and that changes may be made in either without departing from the scope of the invention which is defined in the appended claims.

We claim:

1. In a dishwashing machine having a wash chamber, means for supporting ware to be washed within said chamber, a tank for holding a cleansing liquid, spray means including a pump selectively operable for spraying said liquid from said tank onto ware held within said chamber, heater means for heating said liquid within said tank, and regulating means for regultaing said heater means to maintain said liquid substantially at a first predetermined temperature, the improvement comprising:

said regulating means alternatively regulating said heater means to maintain said liquid substantially at a second predetermined temperature greater than said first temperature; and control means for controlling said heater means and said regulating means such that said regulating means regulates said heater to continuously maintain said liquid at said first temperature whenever said pump is operating, and regulates said heater to raise said liquid to said second temperature, and to continuously maintain said liquid at said second temperature, whenever said pump is not operating.

2. A dishwashing machine as defined in claim 1, wherein said second temperature is greater than said first temperature by an amount substantially within the range of 5° F. to 15° F.

3. A dishwashing machine as defined in claim 1 wherein:

said regulating means includes first and second thermostat means, said first thermostat means being responsive to regulate said heater means to provide said first temperature, and said second thermostat means being responsive to regulate said heater means to provide said second temperature;

said control means includes a first circuit for controlling the energization of said heater; and said control means controls said regulating means by including said first thermostat means within said first circuit whenever said pump is operating, and by including said second thermostat means within said first circuit whenever said pump is not operating.

4. A dishwashing machine as defined in claim 1, wherein:

said regulating means includes temperature measurement means for determining the temperature of liquid within said tank; and said control means is responsive to said temperature measurement means for controlling said heater means to energize said heater means at temperatures within said tank of less than said first temperature, and to energize said heater means at temperatures within said tank between said first and said second temperatures only when said pump is not operating.

5. In a method for washing ware in a dishwashing machine having a wash chamber, means for supporting ware to be washed within said chamber, a tank for holding a cleansing liquid, and spray means including a pump selectively operable for spraying said liquid from said tank onto ware held within said chamber, the method including the steps of (i) supporting ware within said chamber; (ii) operating said pump to spray said liquid onto said ware; (iii) discontinuing operation of said pump; (iv) removing said ware from said chamber; and (v) simultaneous with steps (i), (ii), (iii), and (iv), applying heat to said liquid within said tank; the improvement comprising:

applying only sufficient heat to said liquid within said tank to maintain said liquid substantially at a first predetermined temperature whenever said pump is operating, and to maintain said liquid substantially at a second predetermined temperature greater than said first temperature whenever said pump is not operating.

6. The method as defined in claim 5, wherein said second temperature is greater than said first temperature by an amount substantially within the range of 5° F. to 15° F.

* * * * *